US008093986B2

(12) United States Patent
Harvey

(10) Patent No.: US 8,093,986 B2
(45) Date of Patent: Jan. 10, 2012

(54) SELF-POWERED ELECTRONIC LOCK

(75) Inventor: Michael P. Harvey, Laguna Niguel, CA (US)

(73) Assignee: Lock II, L.L.C., Nicholasville, KY (US)

( * ) Notice: Subject to any disclaimer, the term of this patent is extended or adjusted under 35 U.S.C. 154(b) by 377 days.

(21) Appl. No.: 12/356,324

(22) Filed: Jan. 20, 2009

(65) Prior Publication Data

US 2010/0180649 A1 Jul. 22, 2010

(51) Int. Cl.
*G08B 21/00* (2006.01)

(52) U.S. Cl. ..... 340/5.21; 340/5.2; 340/5.7; 340/5.61; 340/5.63; 70/277; 235/382

(58) Field of Classification Search ..... 340/5.2, 340/5.7, 5.61, 5.63, 5.8, 5.21; 70/277, 278.1, 70/278.2, 278.3; 235/382
See application file for complete search history.

(56) References Cited

U.S. PATENT DOCUMENTS

| | | | |
|---|---|---|---|
| 686,073 | A | 11/1901 | Hollar et al. |
| 1,804,277 | A | 5/1931 | Ruiz |
| 2,399,906 | A | 5/1946 | Bentley |
| 3,024,452 | A | 3/1962 | Leonard |
| 3,097,327 | A | 7/1963 | George |
| 3,318,625 | A | 5/1967 | Bogosian |
| 3,320,490 | A | 5/1967 | Beck |
| 3,468,143 | A | 9/1969 | Douglas |
| 3,633,167 | A | 1/1972 | Hedin |
| 3,718,764 | A | 2/1973 | Deschenes |
| 3,733,861 | A | 5/1973 | Lester |
| 3,796,889 | A | 3/1974 | Fradkin et al. |
| 3,812,403 | A | 5/1974 | Gartner |
| 3,878,511 | A | 4/1975 | Wagner et al. |
| 3,881,171 | A | 4/1975 | Moorman et al. |
| 3,950,678 | A | 4/1976 | Brewer |
| 3,958,231 | A | 5/1976 | Hoffman |

(Continued)

FOREIGN PATENT DOCUMENTS

DE 1065871 9/1959

(Continued)

OTHER PUBLICATIONS

U.S. Patent and Trademark Office, International Search Report and Written Opinion in PCT Application No. PCT/US2010/020600, Mar. 2, 2010.

(Continued)

*Primary Examiner* — Toan N Pham
*Assistant Examiner* — Mark Rushing
(74) *Attorney, Agent, or Firm* — Wood, Herron & Evans, L.L.P.

(57) ABSTRACT

A self-powered electronic lock is provided having a housing, a lock element mounted in the housing for movement relative to the housing between a locked position and an unlocked position, a code input device operating with a first set of electronics, and an electric actuator operating with a second set of electronics. The electric actuator is operatively coupled with the lock element to allow movement of the lock element from the locked position to the unlocked position. A first electric power generator is operative by a user to supply electrical power for operating the code input device and the first set of electronics. A second electric power generator is operative to supply electrical power for operating the electric actuator and the second set of electronics. The first and the second set of electronics are electrically isolated and are synchronized to generate a common number for a combination code.

26 Claims, 6 Drawing Sheets

U.S. PATENT DOCUMENTS 3,978,376 A 8/1976 Wilson
4,095,239 A 6/1978 Gerry
4,114,147 A 9/1978 Hile
4,232,354 A 11/1980 Mueller
4,372,590 A 2/1983 Pilat et al.
4,379,245 A 4/1983 Goldstein
4,387,918 A 6/1983 Dunphy et al.
4,416,127 A 11/1983 Gomez-Olea Naveda
4,433,355 A 2/1984 Chew
4,438,962 A 3/1984 Soloviff
4,446,707 A 5/1984 Mullich et al.
4,457,148 A 7/1984 Johansson
4,502,048 A 2/1985 Rehm
4,609,780 A 9/1986 Clark
4,625,848 A 12/1986 Meyers
4,631,940 A 12/1986 Krivec
4,643,010 A 2/1987 Krivec et al.
4,671,087 A 6/1987 Olenfalk et al.
4,684,945 A 8/1987 Sanderford
4,745,784 A 5/1988 Gartner
4,754,625 A 7/1988 McGourty
4,755,799 A 7/1988 Romano
4,759,062 A 7/1988 Traub
4,766,746 A 8/1988 Henderson et al.
4,770,012 A 9/1988 Johansson
4,832,385 A 5/1989 Llort
4,833,465 A 5/1989 Abend et al.
4,899,562 A 2/1990 Gartner
4,912,460 A 3/1990 Chu
4,977,765 A 12/1990 Legault
5,021,776 A 6/1991 Anderson
5,061,923 A 10/1991 Miller
5,070,714 A 12/1991 Bedford
5,083,122 A 1/1992 Clark
5,182,705 A 1/1993 Barr et al.
5,265,452 A * 11/1993 Dawson et al. ..... 70/278.3
5,299,436 A 4/1994 Spitzer
5,307,656 A 5/1994 Gartner et al.
5,487,290 A 1/1996 Miller et al.
5,517,184 A 5/1996 Miller et al.
5,632,169 A 5/1997 Clark et al.
5,647,235 A 7/1997 Clark
5,653,135 A 8/1997 Miller et al.
5,684,457 A 11/1997 Miller et al.
5,715,716 A 2/1998 Miller et al.
5,720,194 A 2/1998 Miller et al.
5,777,559 A 7/1998 Dawson et al.
5,847,656 A 12/1998 Dawson et al.
5,862,692 A 1/1999 Legault et al.
5,896,026 A 4/1999 Higgins
5,960,655 A 10/1999 Miller et al.
5,973,624 A 10/1999 Miller et al.
6,034,616 A 3/2000 Harvey et al.
6,052,063 A 4/2000 Miller
6,265,973 B1 7/2001 Brammall et al.
6,314,773 B1 11/2001 Miller et al.
6,420,958 B1 7/2002 Miller
6,502,438 B1 1/2003 Miller et al.
6,546,769 B2 4/2003 Miller et al.
6,813,917 B2 11/2004 Miller et al.
6,911,897 B2 6/2005 Miller et al.
6,965,295 B2 * 11/2005 Shimonomoto et al. ..... 340/5.61
7,193,503 B2 3/2007 Fisher
7,263,865 B2 9/2007 Miller et al.
2002/0073753 A1 6/2002 Miller et al.
2002/0167395 A1 11/2002 Miller et al.
2004/0140890 A1 * 7/2004 Hartmann et al. ..... 340/457.1
2007/0204665 A1 9/2007 Lie-Nielsen et al.
2007/0289347 A1 12/2007 Miller et al.

FOREIGN PATENT DOCUMENTS

DE 3817696 11/1989
EP 021670 1/1981
EP 0260860 3/1988
EP 0361881 4/1990
FR 1543004 10/1968
GB 2202577 9/1988
WO 8002710 12/1980
WO 8912154 12/1989

OTHER PUBLICATIONS

Locksmith Ledger International, X-07: A Safe Lock That Operates Electronically, No. 9, Jul. 1991.
U.S. Patent and Trademark Office, Office Action in U.S. Appl. No. 12/554,372, Feb. 28, 2011.

* cited by examiner

SELF-POWERED ELECTRONIC LOCK

FIELD OF THE INVENTION

The present invention relates to locks, and more particularly to self-powered electronic locks.

BACKGROUND OF THE INVENTION

Self-powered locks have been known for some time. Self-powered locks are generally of two types. In the first type, movement of a member such as a knob or a handle provides power to the lock. Entry of the combination is accomplished by, for example, a key or card carrying a code or another code input device. The generation of power is separate from the code entry device.

The other type of such self-powered lock is exemplified by the lock disclosed in U.S. Pat. No. 5,061,923 issued to Miller et al., the disclosure of which is incorporated by reference herein in its entirety. In this type of lock, the same mechanism is used for generation of power for the lock and for the creation of electronic pulses. This type of lock has a permanently engaged drive from a dial to a stepper motor, which outputs voltage pulses in both directions of rotation and provides the same pulses to the microprocessor for purposes of controlling the lock, and in some configurations, for entering the combination.

In general, it is necessary to maintain the desired combination(s) within electronics interior to a safe container, behind a secured door, or in another inaccessible location. The number and status display, by necessity, must be located on the exterior and accessible to the operator of the lock. This has caused self-powered locks to be designed with electrical conductors connected between the outside electronics and the power generation device, which is generally located with the interior electronics. This connection method has proven cost effective in the past, but has caused some challenges during installation and some issues with reliability if the electrical conductors between the interior and exterior electronics become twisted or separated from the interior or exterior electronics.

SUMMARY

Embodiments of the invention provide a self-powered electronic lock including a housing, a lock element, and a code input device. The code input device is accessible to a user and operates with a first set of electronics. The lock element is mounted in the housing and moves relative to the housing between a locked position and an unlocked position. An electric actuator operates with a second set of electronics and is operatively coupled with the lock element to allow movement of the lock element from the locked position to the unlocked position. A first electric power generator supplies electrical power to the first set of electronics and for operating the code input device, while a second electric power generator supplies electrical power to the second set of electronics and for operating the electric actuator. Both the first and second electric power generators are operable by the user. The first and second set of electronics are electrically isolated and are synchronized to generate a common number for a combination code.

In one embodiment, a wireless communication device is configured to allow wireless communication between the first and second sets of electronics in order to transmit non-combination information and to synchronize the first and second set of electronics. The wireless communication methods may include any wireless communications such as communications via Bluetooth® technology, communications via general radio frequency communications, communications via pulsed magnetic fields, communications via pulsed electric fields, or communications via infrared signals, among others.

In some embodiments of the self-powered electronic lock, the second electric power generator and the second set of electronics are located inside the housing. This housing may be an internal housing that is not accessible to the user. Embodiments of the self-powered electronic lock may also include an external housing, which is adapted to be accessible to the user when the lock element is in the locked or unlocked position. The first electric power generator and the first set of electronics may be located inside the external housing. The internal and external housings may also be adapted to be disposed on opposite sides of an intervening structure.

The code input device may be located proximate to or coupled with the external housing to be accessible to the user. The code input device may be any type of device operable to provide a unique code to the self-powered electronic lock such as a dial, a keypad, a card reader, a radio frequency tag, a fingerprint scanner, a retinal scanner, or other biometric devices. Embodiments of the self-powered electronic lock may also include a display, which is electrically coupled to the code input device and powered by the first electric power generator. The display is operable to display a code input to the code input device by the user. Like the code input device, the display may be located proximate to or coupled with the external housing to also be accessible to the user.

In some embodiments of the self-powered electronic lock, the lock includes a rotatable shaft and a dial. The dial may be coupled to the first electric power generator through the rotatable shaft such that rotating the dial transfers a rotational motion to the first electric power generator through the shaft to generate electrical power. Similarly, the dial may additionally be coupled to the second electric power generator through the rotatable shaft such that rotating the dial simultaneously transfers the rotational motion to the first and second electric power generators through the shaft to generate electrical power. In addition to generating power, the dial may also operate as the code input device.

In some embodiments, the internal and external electronics are synchronized through the first and second power generators through the rotation of the shaft. The first and second power generators of the self-powered electronic lock for some embodiments may include stepper motors configured to generate pulses of electrical power. Other embodiments may utilize ring magnets with coils and Hall sensors. Synchronization between the first and second electronics may be established by generating synchronized pulses of electrical power by rotating the dial coupled to the shaft and the first and second power generators, then simultaneously transforming the synchronized pulses of electrical power into corresponding numbers using the first and second sets of electronics.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION

Embodiments of the invention provide a new configuration for an electronic lock having the external electronics separated from the internal electronics, without a need to have a wired electrical connection therebetween. Some embodiments may utilize wireless communications between the internal and external electronics, where the internal electronics may wirelessly transmit an opening status or a change key operation to the external electronics. Separate internal and external generators are utilized to power the internal and external electronics respectively. The internal electronics maintain the desired combination code and bolt retraction mechanism, retaining the security of the enclosure. The external electronics may drive an electronic display and may be synchronized with random number generation algorithms residing in the internal electronics. In the embodiments utilizing wireless communications, no combination information would be transmitted between the internal and external electronics over the wireless communications. In an embodiment with a minimum configuration, there will be no need for either power or data to be transmitted between the electronics in the lock.

Figure 1:
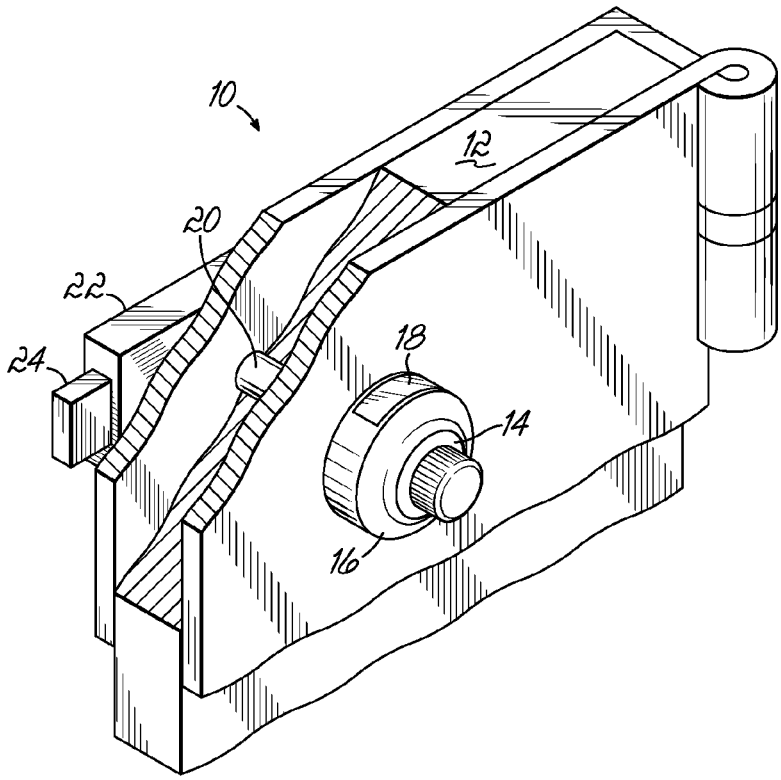
FIG. 1 shows a perspective view of an exemplary electronic lock illustrating an embodiment of the invention.

Referring now to the drawings where like numbers reference like features, generally and in an embodiment of the self-powered electronic lock 10, FIG. 1 shows the lock 10 mounted on a safe or vault door 12. The lock 10, in other embodiments, may also be located on a wall or other surface near the door 12 of the enclosure or room to be secured by the self-powered electronic lock 10. A dial 14 may be surrounded by an external housing 16, such as a dial ring, which shrouds the periphery of the dial 14 and the external electronics (46 in FIG. 2). In some embodiments, the external electronics may also include a display 18. In some embodiments, the external housing 16 supports the display 18. In other embodiments, the display 18 may be mounted separately from the dial 14. The display 18 may be a Liquid Crystal Display (LCD) module, or any other low power consumption display device including a randomly initiated mechanical dial indicator. The dial 14 is attached to a shaft 20, which may also be coupled to the external generator (34 in FIG. 2) such that the rotation of the shaft 20 by the dial 14 causes the external generator to generate power. In some embodiments, the shaft may extend out of the back of the external housing 16, through a wall or door 12 of the enclosure to be secured and into the internal housing 22. In other embodiments, offset shafts may be used that are mechanically linked to one another such that rotation of one shaft would cause the rotation one or more shafts. The internal housing 22 contains the internal electronics (44 in FIG. 2), which track the combination numbers entered on the lock and determine if a valid combination code has been entered. The internal electronics are powered by an internal generator (32 in FIG. 2), which is also coupled to the shaft 20 such that rotation of the dial 14 also causes the internal generator to generate power.

A lock element 24, such as a bolt, may extend from the internal housing 22, and may be used to secure the door 12 when extended. Mechanical linkages and mechanisms (94 in FIGS. 4 and 6) may also be contained in the internal housing 22, which retract or extend the lock element 24 of the self-powered electronic lock 10.

In an embodiment of the self-powered electronic lock 30, pulses from the internal generator 32 and external generator 34 are utilized to indicate motion of the dial. Synchronization transducers 36, 38, indicate a specific, single, rotary position, and direction of movement. The synchronization transducers 36, 38 may be implemented using a variety of technologies like optical, infrared, or magnetic. The use of magnets 40, 42, generally does not require offset gearing and may be less costly to implement.

In some embodiments, the synchronization of the correspondence between the code displayed and internal number is maintained with a method using common random number generators in the internal electronics 44 and the external electronics 46. Generally, the existing random number seeds within a computer 48 in the internal electronics 44 and a computer 50 in the external electronics would be incremented only after a legitimate input number has been entered. In the case of a dial input, the dial 14 would be paused at the desired number, and then upon reversal of the dial the number would be accepted by the computer 48. The computer 50 would not retain this number input. The computer 50 would only record the fact that an acceptable code had been entered, incrementing its random number kernel for the next number to be displayed.

Figure 2:
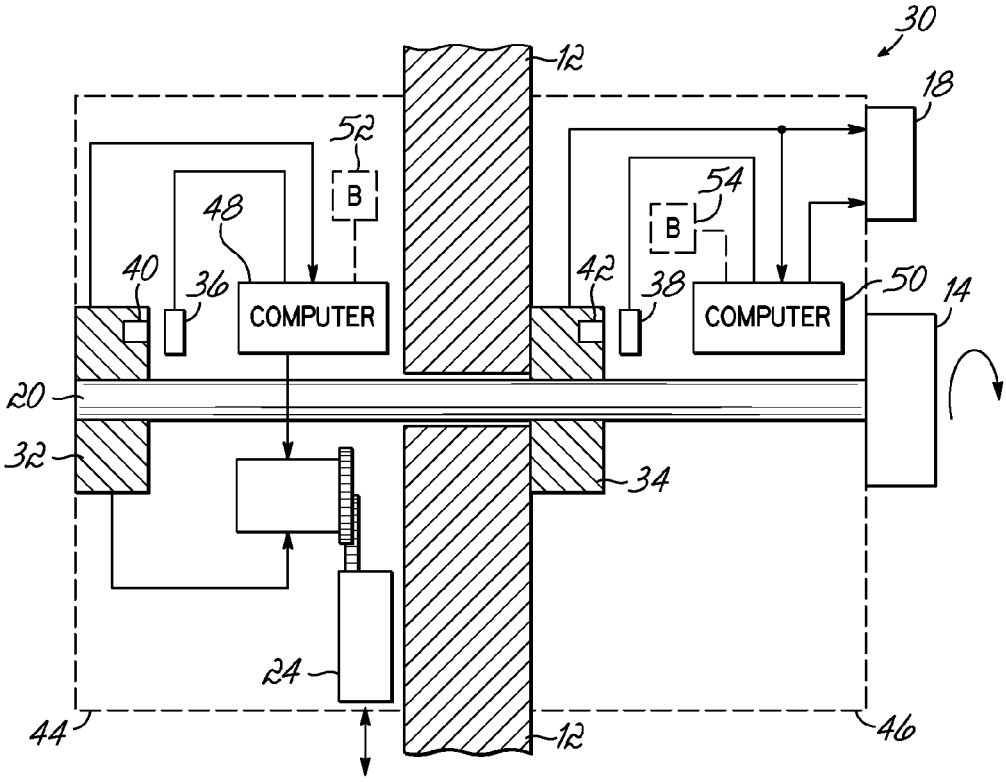
FIG. 2 is block diagram representing the components of an embodiment of the electronic lock in FIG. 1.

In an alternate embodiment of the lock shown in FIG. 2, optional small "keep alive" batteries 52, 54 may be used to reduce the number of turns of the dial necessary to power the electronics, such as computers 48 and 50. In this particular embodiment the batteries charge capacitors through a large resistor (not shown), though other electrical configurations could also be used, such as using the batteries to keep the computers 48, 50 in a sleep mode. The storage capacitors are not gated on to the computers 48, 50 until additional power input is supplied from the generators 32, 34. The stored energy in the capacitors allows for a quicker start of the electronics in the lock, potentially requiring only one or two half turns to start lock operation. The internal and external generators 32, 34, however, are still be used to provide lock power and pull the bolt. In the event either or both of the batteries 52, 54 fail, the lock would operate as set forth in the embodiment above, where all of the power is supplied from the generators 32, 34 and the rotation of the dial 14.

In an embodiment of the self-powered electronic lock 60 with wireless transmission 62-66, the external electronics 46 could be instructed when to increment the random kernel, and when to increment or decrement the displayed number. A wireless transmitter 62 sends wireless signals 64 to a wireless receiver 66. In some embodiments, the transmitter 62 and receiver 66 may be transceivers capable of bi-directional communication. At no time, however, would the internal electronics 44 send the actual code to be displayed by the external electronics 46. The computer 48 in the internal electronics 44 would only transmit an instruction to change the random number kernel, and possibly provide other instructions and/or information to be displayed. This additional information may include, but is not limited to incrementing or decrementing the display, indicating lock change key in operation, reporting total openings and total opening attempts, etc. Wireless communications may utilize RF communications, Bluetooth® communications, pulsed magnetic or electric fields, infrared signals or any other forms of wireless transmission.

In some wireless embodiments, the external electronics 46 may not require encoder technology such as the external generator 34, transducer 38, and magnet 42. Instead, transmissions may be sent from the internal electronics 44 indicating a number change, though the actual number would still be maintained in the computer 50 and not transmitted from the computer 48. In other wireless embodiments having the encoder electronics maintained in the external electronics 46, the internal electronics 44 would not require the encoding electronics such as the internal generator 32, transducer 36, and magnet 40. In this case, the external electronics with the encoder electronics would communicate to the internal electronics the appropriate information. However, at no time would the external electronics retain the actual opening combination.

Figure 3:
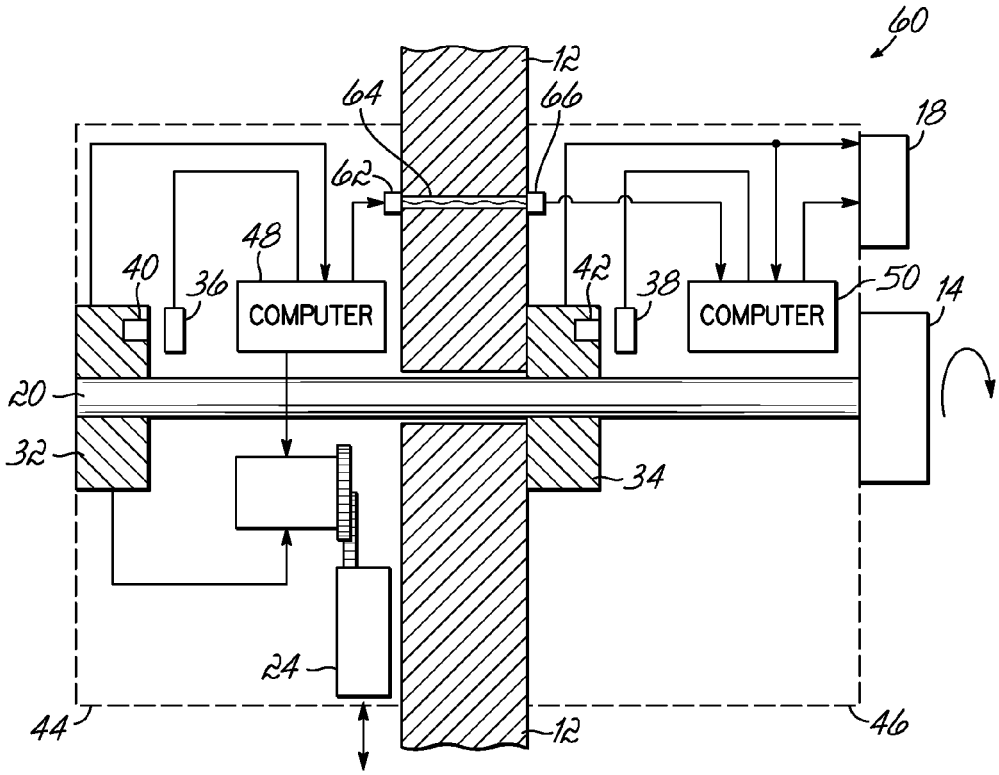
FIG. 3 is block diagram representing the components of an alternate embodiment of the electronic lock in FIG. 2.
Figure 4:
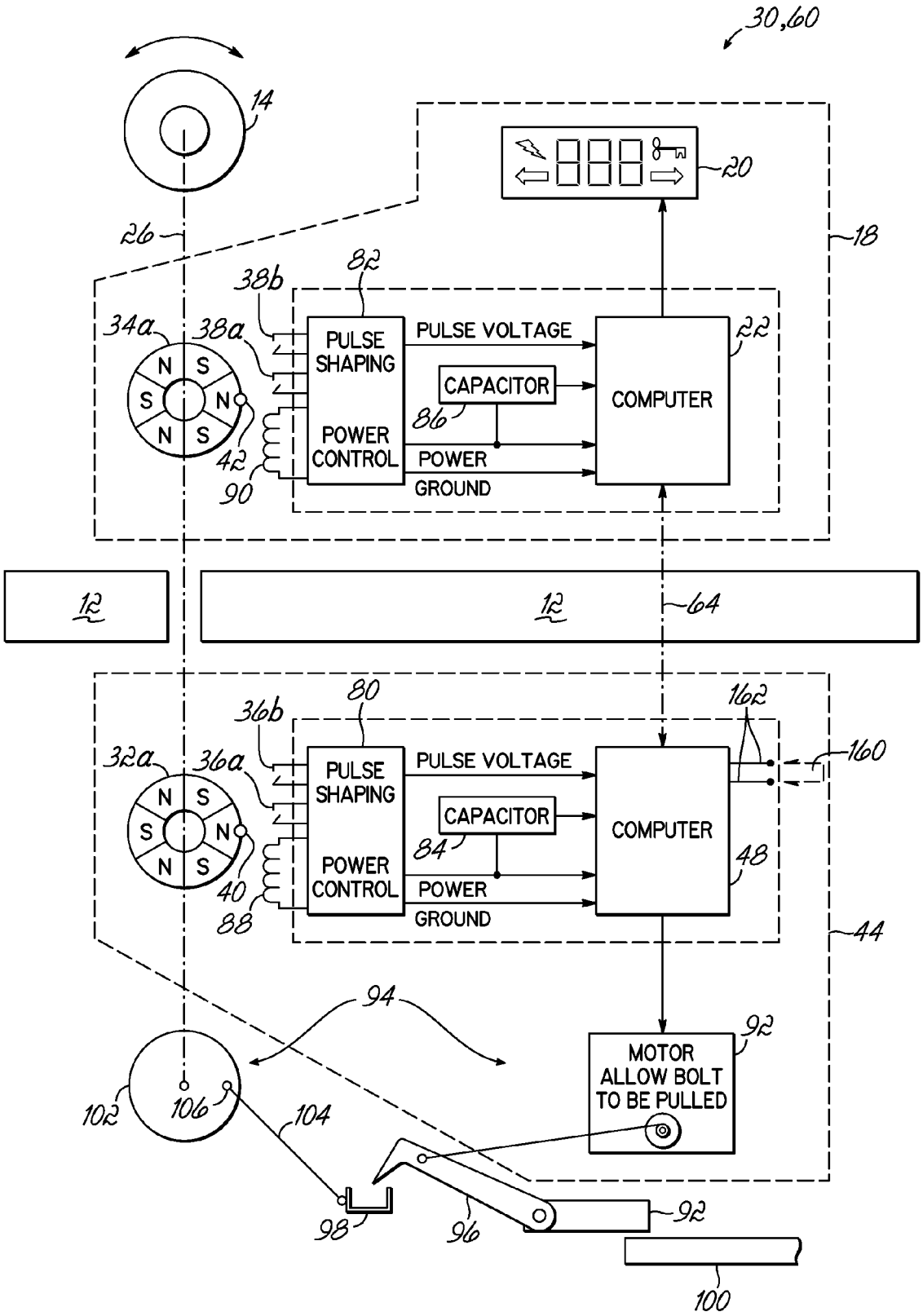
FIG. 4 is another block diagram representing the components of the electronic lock in FIGS. 2-3.

For the embodiments in FIGS. 2-4, the synchronization pulse area is located to be collinear with one of the magnetic ring poles and need only be as precise as the magnetic detents, because the dial always detents at one of the pole locations. The detents for this embodiment may be positioned as 1 in 50 around the dial, with one detent being the synchronization or "index" position. The index position is established by placing a small magnet 40, 42 in coincidence with a magnetic pole of a ring magnet 32*a*, 34*a*, and simple magnetic closure electronics can then be used to indicate both the index position and a direction of rotation. The synchronization pulses are received via contact closures, which may be Hall effect transducers 36, 38 or reed switches. The direction of the dial movement as well as the index point are determined as the combination is being entered. Because, the pulses alternate in polarity for any continuous directional rotation, any instantaneous direction change may be detected from the sequences of data pulses. Any two consecutive pulses of the same polarity indicate a direction change.

In some embodiments of the dual generator lock, it may be necessary to define the inside lock orientation, such as bolt-up, bolt-down, bolt-left, or bolt-right. The orientation may be communicated through the use of a switch or dial electrically connected to the inside electronics. This orientation information may then be used to synchronize the inner and outer electronics. The orientation information, however, would generally not be necessary in embodiments with generator detents and a common shaft, using reed switches for direction and position detection, for example.

With the generator configuration of the embodiments in FIGS. 2-4, distinct positive and negative pulses are received as the magnetic ring 32*a*, 34*a* is rotated. Each detent around the dial 14 produces another of these pulses, either positive or negative. When the direction of the dial 14 is reversed, a pulse is generated with a polarity that is the same as the previous pulse. This allows the lock 30, 60 to detect when a reversal in dial direction has occurred. However, with these pulses alone, the initial direction of the dial 14 cannot be determined.

To determine the initial direction and an index point for "0", this embodiment uses two Hall sensors 36*a*, 38, 36*b*, 38*b*. In other embodiments, reed switches may be used as described above. The Hall sensors 36*a*, 38, 36*b*, 38*b* are placed magnetically next to each other in such a way that the small magnet 40, 42 passes under one, then the other Hall sensor. Direction may then be determined by the order in which signals are received by the Hall sensors 36*a*, 38, 36*b*, 38*b*. This provides for both an index starting point and the direction of rotation. For embodiments using an LCD display with random number generation, only the direction information may be needed. However, if no communication is available because of a failure between the lock and the dial ring, or by design, synchronization may still be maintained between the internal electronics 44 and the external electronics 46 by knowing their common starting point.

Once the starting point and direction is known, a position counter may be incremented or decremented until the next dial reversal. With an LCD display, the incrementing or decrementing occurs from a random starting point as described above. At the time of the dial reversal, the last number is entered as the next combination number. Any practical amount of numbered sequences may be entered, but normally three numbers from 0-99 each are entered. With no LCD, and only a mechanical dial face, synchronization with the index position at "0" makes it possible to know where the dial is pointing.

In some embodiments, when the generator/transducer device is utilized as a position transducer alone, with no coils or iron, there are no voltage pulses to monitor. In this case two Hall sensors 36*a*, 38, 36*b*, 38*b* are mounted facing the ring magnet 32*a*, 34*a* in such a way that they produce pulses that are approximately 90 degrees out of phase. From the way these pulses arrive, the direction and position of each increment can be detected. However, a starting point or "0" is still required. To detect the starting point, only one Hall element is mounted as normal about the small index magnet 40, 42. This method may also be utilized for the generator case above.

The power control and pulse shaping devices 80, 82 may supply pulsed power directly to the internal and external electronics 44, 46 respectively. In alternate embodiments, the power control and pulse shaping devices 80, 82 may also charge internal capacitors 84, 86 with the pulses of electricity generated from alternating magnets which are part of the ring magnets 32*a*, 34*a* in the generators 32, 34 and electrical components 88, 90. The voltage of the capacitors 84, 86 may then be supplied to the respective computers 48, 50. The computers 48, 50 may be powered for a limited time from the capacitor voltage. Powered time of the computers 48, 50 will be dependent upon the capacitance of the capacitor 84, 86 and as well as the current drain of the computer 48, 50, the external electronics 46, and the current drain of the display 18. Similarly, the voltage and current resources required by a latch motor 92 in the internal electronics 44 will be a determining factor for the internal capacitor 84. The size of the capacitor may be selected in coordination with the power requirements of the remainder of the system to provide power to the system for a fixed period of time, for example approximately 90 seconds, after the dial 14 and the generators 32, 34 have ceased to rotate. The time period should provide adequate time to open the lock 30, 60 or to pause in the entry of the combination without losing the previously entered elements of the combination. The time period may also be long enough to provide a significant delay in the reset of the lock electronics after the lock has become unopenable due to any of several conditions having occurred. This delay period may be a significant factor to defeat the use of a dialer for unauthorized entry into the secured enclosure. In some embodiments, the power requirements of the external electronics 46 may differ from the internal electronics 44. In these cases, the capacitors 84 and 86 may be different and chosen to match the power requirements of each side of the lock 30, 60. However, requirements for some embodiments may include a synchronization of power-up detection to within the resolution of the index passage.

Computer 48 may also have an output to a latch motor 92 of the lock bolt retraction mechanism 94, which acts to connect the latch 96 of the self-powered electronic lock 30, 60 to the bolt retractor 98. The latch 96 may be an arm, which when engaged with the bolt retractor 98, may be pulled or pushed by the bolt retractor 980 when it is moved. The latch motor 92 may consist of a rotary actuator, or a rotary and lifting actuator, in the form of a small rotary mechanism for moving the latch 96. The lock element 24 may be connected to the latch 96 and may be constrained by the internal housing 22, as shown in FIG. 1, to a sliding movement. The lock element 24 may be extended or retracted as necessary to lock or unlock the enclosure 100, such as a safe, vault, room, etc.

Figure 6:
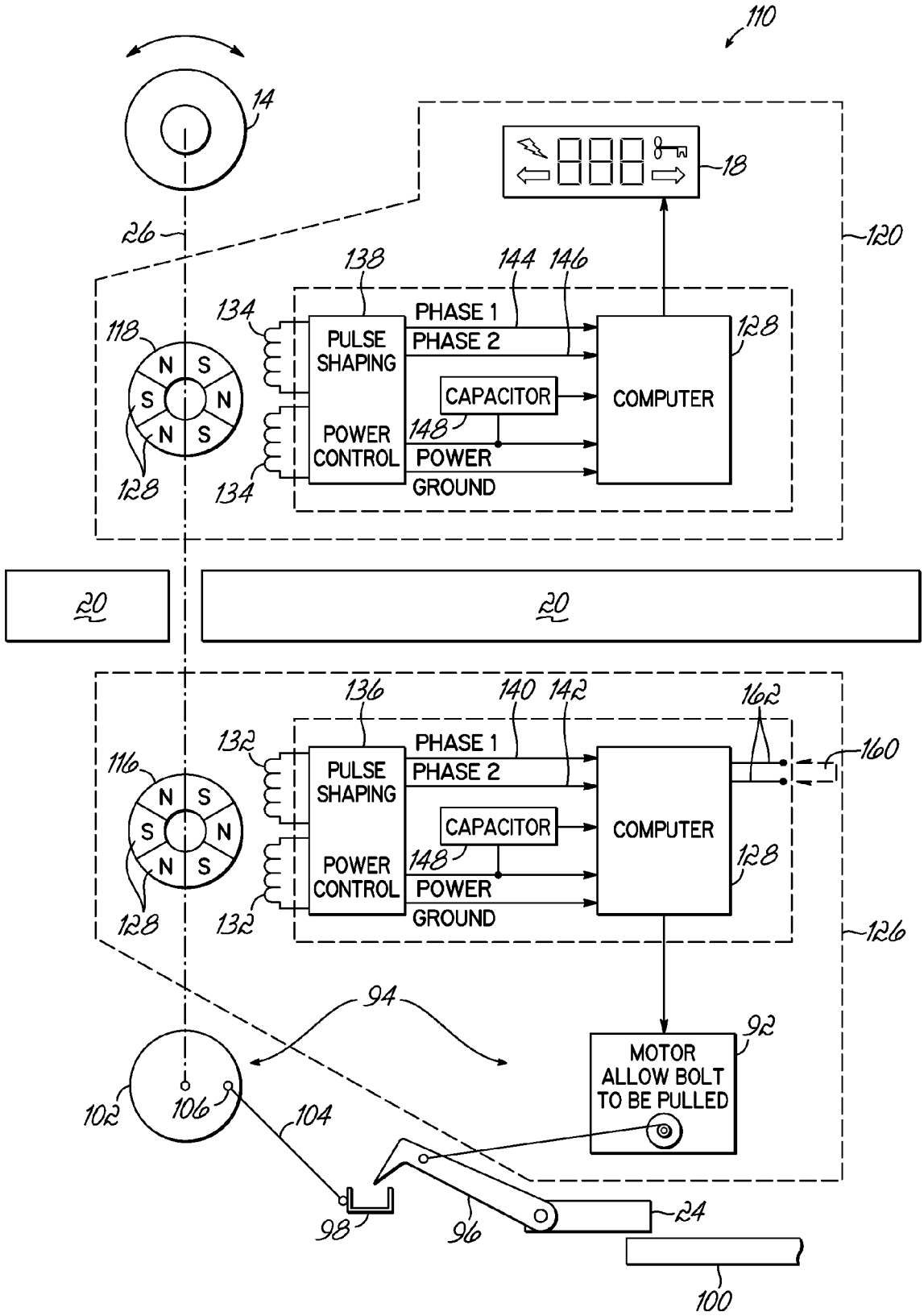
FIG. 6 is another block diagram representing the components of the electronic lock in FIG. 5.

Bolt retractor 98 may be engaged with the retractor drive 102 by a link 104, as best seen in FIGS. 4 and 6. The link 104 converts the movement of the retractor drive 102 and engaging point 106 into a linear movement of the bolt retractor 98. The retractor drive 102 may be coupled to the shaft 20 such that rotation of the dial 14 provides the proper motion to the retractor drive after completing the entry of the combination code. In alternate embodiments, the latch motor or a similar motor may be employed to automatically move the bolt retractor 98 after successful entry of the combination code.

Figure 5:
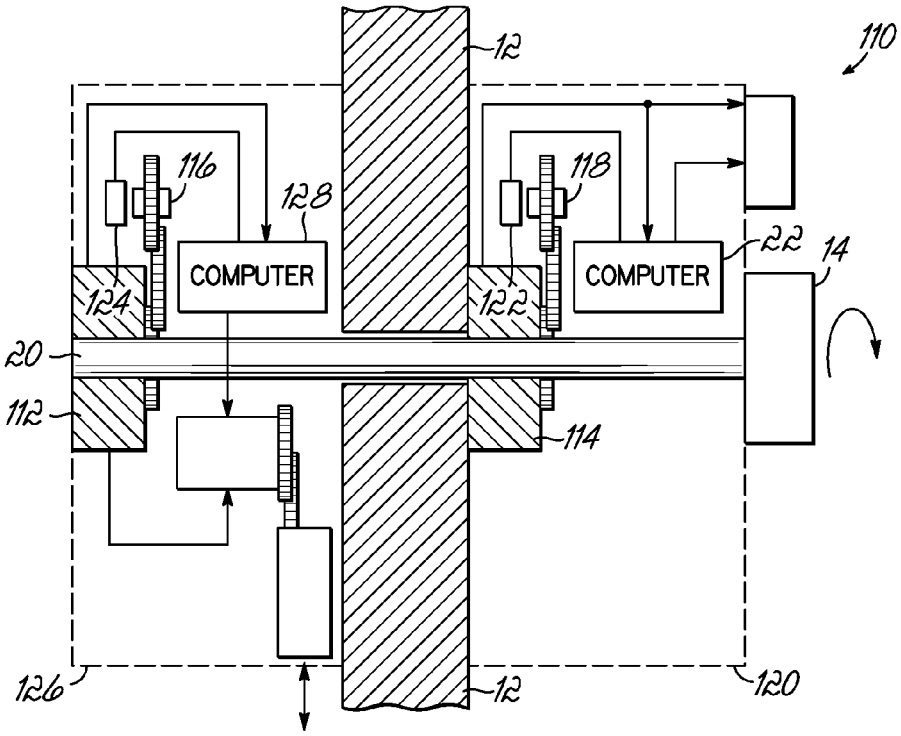
FIG. 5 is block diagram representing the components of an alternate embodiment of the electronic lock in FIG. 1.

In an alternate embodiment of the self-powered electronic lock 110 and as best seen in FIGS. 5, 6, generators 112, 114 are used to drive rotating encoder magnets 116, 118. Referring to the external electronics 120, an electrical component 122 may be located under the external rotating encoder magnet 118 to provide rotational position information. A similar electric element 124 may be provided in the internal electronics 126 and similarly positioned with the internal rotating encoder magnet 116. This type of element is reliable and relatively impervious to general dust, dirt, or humidity conditions. Other technologies in other embodiments such as piezo based or any other generator implementation may also be used to provide positional information.

In some embodiments, the dial 14 may serve multiple purposes. As described above in conjunction with the embodiments in FIGS. 2-4, the dial 14 may be connected to the internal and external generators 112, 114 through shaft 20 such that turning the dial causes the generators 112, 114 to generate power. The dial may also serve to generate magnetic pulses used by the internal and external computers 128, 130 that may be created through gears, which transfer the rotation of the shaft at the generators 112, 114 to encoder magnets 116, 118. The internal and external generators 112, 114 may be used to both generate power and generate pulses used by the internal and external computers 128, 130. Alternatively, the encoder magnets 116, 118 may be directly coupled to the shaft 20 and may also act as rotors for the generators for power generation. The encoder magnets 116, 118 may consist of a plurality of segmented magnetic members 128 having alternating polarity. The number of segmented magnetic members 128 on the encoder magnets 116, 118 is not critical and may be selected to provide fewer field direction changes per revolution of the encoder magnets 116, 118. More field changes may easily be obtained by increasing the diameter of the systems, or by offsetting multiple magnetic rings. The magnetic fields of the segmented magnetic members may extend to and interact with internal and external electrical components 132, 134, such as coils, which are placed in proximity to the encoder magnets 116, 118, to generate pulses of electricity.

Prior implementations of the generators 112,114 have utilized an off the shelf stepper motor driven as a generator, which provides power and the ability to produce general rotational motion and direction information. Generators 112, 114 used with an embodiment of the invention may be configured conceptually as one-half of a modified stepper motor with an additional indexing magnetic element. Each generator 112, 114 may have slight detents at, for example, 50 positions (not shown). The generators 112, 114 may be configured directly in coincidence for 50 detents, or in other embodiments may be mounted askew by one-half detent position to develop 100 detent positions around the dial. It is not intended that the generators 112, 114 will require any gearing, although certain prior implementations of self-powered locks have utilized gearing. Use of gearing in the lock 110 would potentially add complexity, require additional space, and add additional cost. The additional detent configuration may be useful in certain embodiments of the self-powered electronic lock 110 as the additional detent positions may allow more rapid number advance for a given rotational angle. Previous implementations relied on speed of rotation instead of rotational position. In some embodiments, rate input may be implemented in lock 110. In general, one detent will produce one number increment or decrement depending on the direction of rotation.

Encoders for embodiments having 100 detent positions around the dial should have a minimum of 100 increments per revolution to achieve the desired operation of 100 dial positions per revolution of the dial. In some embodiments, it may be desirable to be able to have some variability in the dial rotation input so that additional increments may be desired, e.g. 200 to 400. An embodiment with an encoder having 1000 or more increments per revolution would provide a minimum of five discernable positions on either side of the desired number location in general.

Any of the generally available rotational encoders are acceptable for use, such as the AS5040 manufactured and sold by Austria Micro Systems. The AS5040 utilizes a non-contact magnetic element, has low power requirements, and is small in diameter, which makes it well suited for this application. In addition, this hardware may be much more cost effective than equivalent optical implementations.

As the encoder magnets 116, 118 are rotated by the dial 14 and shaft 20, a series of absolute encoder readings may be obtained. The voltage and power generating pulses are fed to the respective power controls and pulse shaping devices 136, 138 shown in FIG. 6, which are both rectified for power and shaped and detected for incrementing and decrementing. The shaping of the pulses may be accomplished by circuitry that is conventional and forms no part of this invention. The pulses may then be fed to the respective computers 128, 130, such as microprocessor devices, over the phase lines 140-146 which may be interpreted a data pulses with direction change detection, sync, or index pulse with direction detection. The index pulses may be out of phase so they may be used to determine the direction of the rotation of the encoder magnets 116, 118.

The power control and pulse shaping devices 136, 138 may supply pulsed power directly to the internal and external electronics 126, 120. In alternate embodiments, the power control and pulse shaping devices 136, 138 may also charge internal capacitors 148, 150 with the pulses of electricity generated from the encoder magnets 116, 118 and electrical components 122, 124. The voltage of the capacitors 148, 150 may be determined similar to the embodiments in FIGS. 2-4 described above.

External computer 130 as well as external computer 50 may provide outputs to the display 18. The display may be capable of displaying numerals of at least two digits and arrows pointing in opposite directions. Symbols, such as arrows pointing in opposite directions, lightning bold for an error symbol, or a key symbol, may be used to indicate selection of the combination change mode as with previous electronic locks. LCD dot matrix displays may also be utilized to display the above information as well as additional status information in a more readable format. For example, the time of day and more readable reporting may be displayed in a ticker-tape fashion with backlit displays. Color displays may be desirable for some embodiments.

The display 18, as described above, may be a Liquid Crystal Display or LCD device, which has an advantage of being a relatively low consumer of electrical power. Low power consumption may be a significant consideration because power generated by the rotation of the lock dial is relatively small and must be stored within the components of the electronics of the external power control and pulse shaping components 138 and 82 of the system.

As with the embodiments described above, computers 128, 130 each have separate functions within the electronic lock 110. The external computer 130 may display the combination number entry and may send this information to the display 18. Additionally, the external computer 130 may send other indicators to the display 18, such as those described above in conjunction with the display 18. Internal computer 128 may also track the combination number entry, in some embodiments, simultaneously with the external computer 130.

Computers 128, 130 communicate through mechanical means such as that illustrated in the embodiment in FIGS. 5 and 6. In this embodiment, computers 128, 130 may communicate wirelessly through the mechanical rotations of the shaft 20, which provide synchronized pulses through the encoder magnets 116, 118 and electrical components 122, 124 to each computer 128, 130 respectively. Software resident in the computers 128, 130 may transform the synchronized pulses into corresponding numbers between the computers 128, 130. The internal computer 128 may then perform checks of the entered combination numbers, as done in previous electronic locks, while the external computer 130 may display the numbers. This configuration requires no electrical conductors between the internal and external computers 128, 130 or other internal and external electronics 126, 120. This configuration may allow for embodiments having an installation of the internal and external electronics 126, 120 to be far off axis and/or mounted at greater distances, as long as they are mechanically linked. Bolt retractor mechanisms for this embodiment operate similar to those described with the embodiments in FIGS. 2-4 above.

The computers 48, 50, 128, 130 may be any suitable microprocessors manufactured and sold on the market, such as the 80C51F manufactured and sold by Oki Electronic Industries Company, Ltd., of Tokyo, Japan, or one of several microcontrollers manufactured by Microchip incorporated in the U.S.A.

As with some prior electronic locks, and in the embodiments of the self-powered electronic lock 30, 60, 110 the lock combination code may be changed with the use of a change key 160. If the current combination code of the lock has been entered correctly, the ports 162 of the internal computer 48, 128 may be checked to see if the change key 160 has been inserted into the ports 162. If the change key 162 has been inserted, a new combination code for the lock may be generated and confirmed. Because the combination for the lock is only stored in the internal computer 48, 128 in the internal housing 22, there may be no need to insert the change key 160 into the external computer 50, 130 in the external housing 16. In the embodiment shown in FIG. 3, the wireless communications 64 may be used to indicate that the change key 160 has been inserted into the ports 162 on the display 18.

In the embodiments described above, the dial 14 is utilized to enter the plurality of combination numbers that make up the combination code. In alternate embodiments, other devices may be utilized to enter the combination numbers, such as a keypad, magnetic card reader, or radio frequency ID card or tag. In still other embodiments, the lock may respond to biological characteristics recognized by biometric devices, such as a fingerprint or retinal scan, either in conjunction with a combination code, or exclusive of entry of a combination code or personal identification number (PIN). In these alternate embodiments, the dial 14 may still be utilized to generate power to the internal and external electronics 44, 46, 126, 120 as well as be used to actuate the lock element 24.

Figure 7:
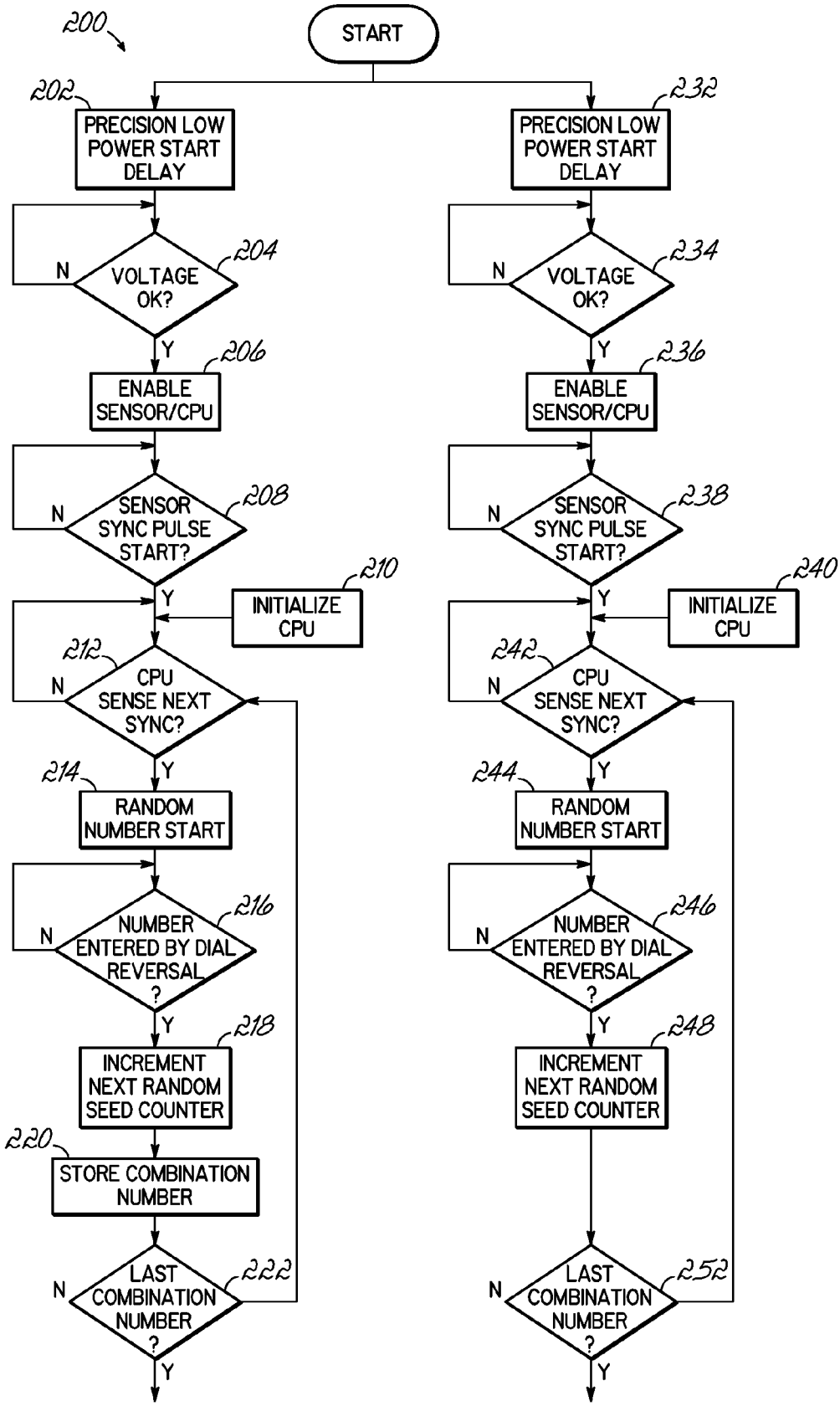
FIG. 7 is a flow chart of an exemplary power up and dial sequence of the electronic lock in FIG. 1.

FIG. 7 shows an exemplary power up and dialing sequence of the self-powered electronic lock 30, 60, 110. The process begins when the dial is rotated. The sequence between the internal and external electronics may be composed of similar steps, performed at similar times, which assists in maintaining a synchronization between the internal and external electronics. A delay may be imposed on the internal and external electronics as the dial rotation begins, for some embodiments, in order to charge the capacitor (blocks 202, 232). The delay may be prolonged if there is insufficient voltage to start the electronics (no branch of decision blocks 204, 234). If the voltage is sufficient to power the power-up electronics (yes branch of decision blocks 204, 234), the sensor is enabled (block 206, 236) to test for a complete index or sync pulse after the power is enabled to these components. After the sync or index location is indicated, the computers may be enabled. In some embodiments, after the index point, the microprocessor (CPU) will have time to power up and initialize itself. At this point in the power-up sequence, both CPUs will be powered up and waiting for the next sync, or index location. After detecting the passage of the index location, the next random number is displayed and internally examined at 218, 248. Both internal and external computers increment or decrement in unison until a dial reversal is detected. At this point the indicated number is stored in the internal computer and the next random number is calculated for display and internal calculation and comparison by the internal computer.

A random number may be generated as a starting point in both the internal and external computers based on a previous seeding value (blocks 214, 244). To keep the random number generation the same between the two computers, which may not be in electrical communication with each other, the same random number generation algorithm and seeding value may be used in both the internal and external computers. In some embodiments utilizing other wireless communications, the external computer may be the only computer that may need to generate random numbers as the alternate wireless communication methods may not require a synchronization of the internal and external electronics.

Seed values, in some embodiments, may be determined by a predefined table of seed values for resynchronization purposes. The seed value for the next random number may be the currently generated random number. In the event synchronization between the internal and external electronics is lost, one method for resynchronization may be to power up the lock by continuous dialing to the right. After the lock has been powered, a combination code of 00-00-00 could be entered. This would cause the lock to reseed the random number generator to the next seed number in the table, and also re-zero the transducers. The transducers may have to be re-zeroed due to mechanical wear, or due to the external dial ring, or dial misalignment, which may occur due to the physical movement of the components in relation to one another.

Entry of a combination number may be detected by the reversal of the dial and a continuing of the reversal motion for a predetermined number rotations. If the dial is reversed (yes branch of decision blocks 216, 246), then the random seed counter is incremented (blocks 218, 248) and the combination number is stored in the internal computer (block 220). If the number is not the last number in the combination code (no branch of decision blocks 222, 252) the process continues at blocks 212, 242. If the number is the last number in the combination code (yes branch of decision blocks 222, 252), then the internal computer checks the combination code against the existing defined combination and operates as similar prior art locks, such as the electronic lock disclosed in U.S. Pat. No. 5,061,923 of Miller et al. Once a combination number has been entered, internal counters in both internal and external electronics are incremented and permanently stored. This counter may be used as a basis for the next random number displayed. In some embodiments, a modified random delay sequence may be implemented in which the last number input is the next starting number, and the randomness between dial rotation and display is accomplished through firmware located in both internal and external electronics. As described above, if no wireless communication is maintained, the external computer would detect the opening by an appropriate stall at the opening position of the dial. In the case of no wireless communication, this fact would not be used in the generation of the next displayed random number, only the fact that an acceptable number has been entered, no matter what the number was.

Detection of autodialer manipulation would be accomplished in the internal electronics. For example, if too many combinations are entered without opening, or combinations are entered too fast, the internal electronics would stop the checking for legitimate combination entry. The external electronics and computer could be made to determine that a legitimate combination had been entered in the case of non-wireless operation, but no bolt pulling sequences would ever occur. In this case, a real combination could have been dialed, but the internal computer would not detect it as legitimate, if autodialed, unless the combination was dialed in the first few dialing attempts. As continuing attempts to dial random combinations on power up are performed, delays would be built into prohibitively allow random combinations to be entered to the point that multiple entries of the correct combination must be entered to open the lock.

Figure 8:
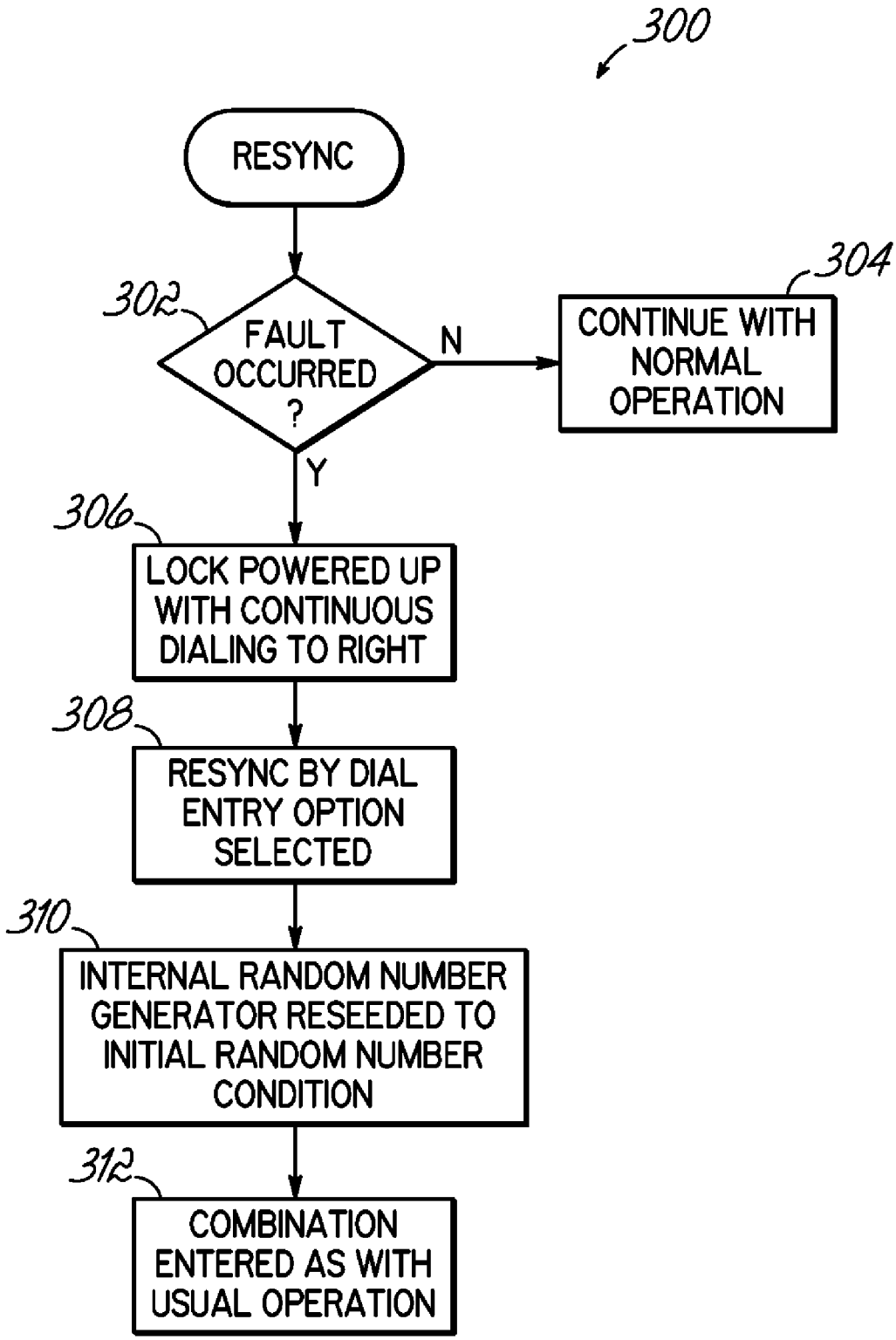
FIG. 8 is a flow chart of an exemplary resynchronization process of the electronic lock in FIG. 1.

If the self-powered electronic lock experiences an intermittent failure of a component or a problem with a trace on a printed circuit board, causing a fault in the lock, the internal and external electronics may become unsynchronized. The self-powered electronic lock may be resynchronized to overcome the fault as shown in the flow diagram in FIG. 8. If there is no fault (no branch of decision block 302) then the lock continues to operate under normal conditions (block 304). If there is a fault condition (yes branch of decision block 302), the lock may be powered up with continuous dialing of the lock, for example, to the right (block 306). Once powered up, the resynchronize by dial entry option is selected (block 308), by for example, additionally dialing the combination 00-00-00. This option causes the internal random number generators in the internal and external computers to be reseeded with the next random number from an internal table (block 310), thus resynchronizing the internal and external electronics. The lock then continues to operate under normal conditions (block 312).

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of applicant's general inventive concept.

What is claimed is:

1. A self-powered electronic lock, comprising:

a housing;

a lock element mounted in the housing for movement relative to the housing between a locked position and an unlocked position;

a code input device operating with a first set of electronics;

an electric actuator operating with a second set of electronics, the electric actuator operatively coupled with the lock element to allow movement of the lock element from the locked position to the unlocked position;

a first electric power generator operative by a user to supply electrical power for operating the code input device and first set of electronics; and a second electric power generator operative by the user to supply electrical power for operating the electric actuator and the second set of electronics, wherein the first and second set of electronics are electrically isolated, and wherein the first and second set of electronics are synchronized to generate a common number for a combination code.

2. The self-powered electronic lock of claim 1 further comprising:

a first battery electrically connected to the first set of electronics, wherein the first battery provides power to the first set of electronics to supplement the electrical power supplied by the first electric power generator for starting lock operation.

3. The self-powered electronic lock of claim 1 further comprising:

a second battery electrically connected to the second set of electronics, wherein the second battery provides power to the second set of electronics to supplement the electrical power supplied by the second electric power generator for starting lock operation.

4. The self-powered electronic lock of claim 1 further comprising:

a wireless communication device configure to allow wireless communication between the first and second sets of electronics to transmit non-combination information and to synchronize the first and second set of electronics.

5. The self-powered electronic lock of claim 1 wherein the first set of electronics is operable to display the common number and the second set of electronics is operable to check the common number against the combination code stored in the second set of electronics.

6. The self-powered electronic lock of claim 1 wherein the second electric power generator and the second set of electronics are located inside the housing.

7. The self-powered electronic lock of claim 6 wherein the housing further comprises an internal housing, and the self-powered electronic lock further comprises:

an external housing adapted to be accessible to the user of the self-powered electronic lock when the lock element is in the locked or unlocked position, wherein the internal housing and external housing are adapted to be disposed on opposite sides of an intervening structure.

8. The self-powered electronic lock of claim 7 wherein first electric power generator and the first set of electronics are located inside the external housing.

9. The self-powered electronic lock of claim 7 wherein the code input device is located proximate to or coupled with the external housing and accessible to the user.

10. The self-powered electronic lock of claim 1 wherein the code input device further comprises at least one of a dial, a keypad, a card reader, a radio frequency tag, a fingerprint scanner, a retinal scanner, or other biometric device.

11. The self-powered electronic lock of claim 1 further comprising:

a rotatable shaft; and a dial coupled to the first electric power generator through the rotatable shaft, wherein rotating the dial transfers a rotational motion to the first electric power generator through the shaft to generate electrical power.

12. The self-powered electronic lock of claim 11 wherein the dial is additionally coupled to the second electric power generator through the rotatable shaft, and wherein rotating the dial transfers the rotational motion to the first and second electric power generators through the shaft to generate electrical power.

13. The self-powered electronic lock of claim 12 wherein the rotatable dial further operates as the code input device.

14. The self-powered electronic lock of claim 1 further comprising:

a display electrically coupled to the code input device and powered by the first electric power generator, the display operable to display code input by the user with the code input device.

15. The self-powered electronic lock of claim 14 wherein the display further comprises a liquid crystal display (LCD).

16. The self-powered electronic lock of claim 1 wherein the first and second electric power generators comprise a stepper motor.

17. The self-powered electronic lock of claim 1 wherein the first and second electric power generators comprise a ring magnet, a coil, and a Hall sensor.

18. A method of operating a self-powered electronic lock, wherein the self-powered electronic lock includes a lock element, an electric actuator, a code input device, first and second electric power generators, and first and second sets of electronics, the method comprising:

generating electrical power with the first electric power generator;

generating electrical power with the second electric power generator;

inputting a proper code into the code input device operating with the first set of electronics using the power generated by the first electric power generator and not using the power generated by the second electric generator;

simultaneously generating information in the second set of electronics synchronized with the first set of electronics, the information indicative of the proper code being entered into the code input device; and using the power generated by the second electric power generator and not using the power generated by the first electrical generator, activating the electric actuator as a result of the information generated in the second set of electronics to thereby allow movement of the lock element from a locked position to an unlocked position.

19. The method of claim 18 wherein inputting the proper code further comprises at least one of:

rotating a dial, depressing a keypad, inserting a card into a card reader, reading a radio frequency tag, scanning a fingerprint, scanning a retina, or inputting other biometric information.

20. The method of claim 18 wherein the self-powered lock further includes a dial coupled to the first electric power generator through a rotatable shaft, and wherein generating electrical power comprises:

rotating the dial to transfer a rotational motion to the first electric power generator through the shaft to generate electrical power.

21. The method of claim 20 wherein the dial is also coupled to the second electric power generator through the rotatable shaft, and wherein generating electrical power comprises:

rotating the dial to transfer a rotational motion to the first and second electric power generators through the shaft to generate electrical power.

22. The method of claim 20 wherein inputting the proper code further comprises inputting the code by rotating the dial.

23. The method of claim 22 wherein the proper code comprises a series of numbers, and wherein the self-powered electronic lock further includes a display, powered by the first electric power generator, and wherein inputting the proper code comprises:

rotating the dial to a position corresponding to a first number in the series of numbers;

displaying the first number on the display corresponding to the rotation of the dial; and reversing the rotation of the dial to input the first number in the series of numbers and indicate a start of an entry of a second number in the series of numbers.

24. The method of claim 21 wherein the first and second electric power generators comprise stepper motors configured to generate pulses of electrical power, and wherein simultaneously generating information comprises:

generating synchronized pulses of electrical power with the stepper motors by rotating the dial coupled to the shaft and the first and second power generators; and simultaneously transforming the synchronized pulses of electrical power into corresponding numbers using the first and second sets of electronics.

25. The method of claim 21 wherein the first and second electric power generators comprise a ring magnet, a coil and a Hall sensor, and wherein simultaneously generating information comprises:

generating synchronized pulses of electrical power in the coil by rotating the dial coupled to the shaft thereby rotating the ring magnet;

determining a direction of the rotation of the dial with the Hall sensor; and simultaneously transforming the synchronized pulses of electrical power into corresponding numbers using the first and second sets of electronics.

26. The method of claim 18 further comprising:

wirelessly communicating synchronization information and information not related to the proper code between the first and second sets of electronics, wherein wirelessly communicating includes at least one of: communicating the information via Bluetooth technology, communicating the information via general radio frequency communications, communicating the information via pulsed magnetic fields, communicating the information via pulsed electric fields, or communicating the information via infrared signals.

* * * * *

UNITED STATES PATENT AND TRADEMARK OFFICE

CERTIFICATE OF CORRECTION

PATENT NO. : 8,093,986 B2
APPLICATION NO. : 12/356324
DATED : January 10, 2012
INVENTOR(S) : Michael P. Harvey It is certified that error appears in the above-identified patent and that said Letters Patent is hereby corrected as shown below:

Column 12

Claim 1, line 22, change “set” to --sets--.

Claim 1, line 24, change “set” to --sets--.

Claim 4, line 47, change “set” to --sets--.

Signed and Sealed this
Sixth Day of March, 2012

David J. Kappos

David J. Kappos
*Director of the United States Patent and Trademark Office*